United States Patent [19]

Sanzenbacher et al.

[11] 4,358,310

[45] Nov. 9, 1982

[54] DRY COLLECTION OF METALLIZED FINES

[75] Inventors: Charles W. Sanzenbacher; David C. Meissner, both of Charlotte, N.C.

[73] Assignee: Midrex Corporation, Charlotte, N.C.

[21] Appl. No.: 235,487

[22] Filed: Feb. 18, 1981

[51] Int. Cl.[3] ..... C22B 7/02

[52] U.S. Cl. ..... 75/25; 55/1; 55/429; 75/35; 165/104.16; 266/155; 266/156; 266/157

[58] Field of Search ..... 266/155, 156, 157; 75/25, 34, 35; 55/429, 428, 1; 165/104.16

[56] References Cited

U.S. PATENT DOCUMENTS

| | | | |
|---|---|---|---|
| 2,915,365 | 12/1959 | Saussol | 55/428 |
| 4,169,533 | 10/1979 | Rubio | 75/34 |
| 4,207,093 | 6/1980 | Pastorino et al. | 75/34 |

*Primary Examiner*—M. J. Andrews
*Attorney, Agent, or Firm*—Ralph H. Dougherty

[57] ABSTRACT

A method and apparatus for the dry collection of metallized fines from a direct reduction furnace cooling zone in which cooling gas removed from the cooling zone passes through a dust collector and the removed dust is cooled in a fluidized bed, the fluidizing gas being recirculated through an indirect cooler. The process is continuous and the fines are collected at a sufficiently low temperature for easy handling. The apparatus includes a hot gas cyclone in the cooling gas withdrawal line connected to a fluidized bed cooler, a conduit for withdrawing fluidizing gas from the fluidized bed cooler passes through a second cyclone dust collector then through an indirect cooler and returns to the fluidized bed cooler. Cool fines are withdrawn from the fluidized bed cooler into a collector.

10 Claims, 2 Drawing Figures

DRY COLLECTION OF METALLIZED FINES

BACKGROUND OF THE INVENTION

In the direct reduction of iron oxide to metallized iron in a shaft furnace, particulate iron oxide is fed to the top of the furnace and particulate metallized product is removed from the bottom, which creates a gravitational flow of the burden through the furnace. Hot reducing gas is introduced to the burden intermediate the ends of the furnace and in most shaft furnace processes, a cooling gas is introduced to the burden near the discharge end of the furnace to cool the metallized product prior to discharge, after which the heated cooling gas is removed from the cooling zone, cleaned, cooled, and recirculated.

During the reduction process, stresses are created within the particles of material being reduced, primarily due to a change in crystal structure during reduction from hematite to magnetite. Particulates in the form of pellets or natural lump ores have adequate elasticity to accommodate these stresses; however, some finely divided particles of material are created. These are known as fines.

About one percent of the total output of a direct reduction shaft furnace is removed as solid fines entrained in the cooling zone gas withdrawn from the furnace. The entrained solids are separated from the gas in a cooling gas cooler-scrubber as sludge, or they are carried into a clarifier and discharged as sludge with the clarifier underflow. Such sludge has a high percentage of iron; therefore, it is desirable to reclaim the iron by agglomerating and reprocessing the material in the direct reduction furnace. Alternatively, the sludge may be utilized as feed for a sintering machine. Recently such sludge has been briquetted with dry dust created elsewhere in the direct reduction process. This latter method is a lower-cost recovery method where inexpensive ores which generage large amounts of fines are being used.

Where direct reduction plants operate with higher quality ores which produce lower quantities of metallized fines, these fines may be injected in limited amounts directly into electric arc steelmaking furnaces. When fines are not briquetted it is desirable to collect the maximum amount of dry iron fines possible. By maintaining the fines in the dry state, the agglomeration of fines due to rusting (rust bonding) is avoided.

OBJECTS OF THE INVENTION

It is an object of the present invention to provide means for collecting metallized iron fines removed from the cooling zone of a direct reduction furnace as solids entrained in the removed cooling gas.

It is also an object of this invention to continuously collect and cool metallized fines with no loss of metallization.

It is also an object of this invention to collect and cool metallized fines in a dry condition with no rust bonding of the fines.

SUMMARY OF THE INVENTION

The foregoing and other objects of this invention are achieved by providing a cyclone dust collector in the cooling gas removal system, the cyclone dust discharge feeding a fluidized bed fines cooler associated with an indirect gas cooler and an overflow fines collector.

DETAILED DESCRIPTION

Figure 1:
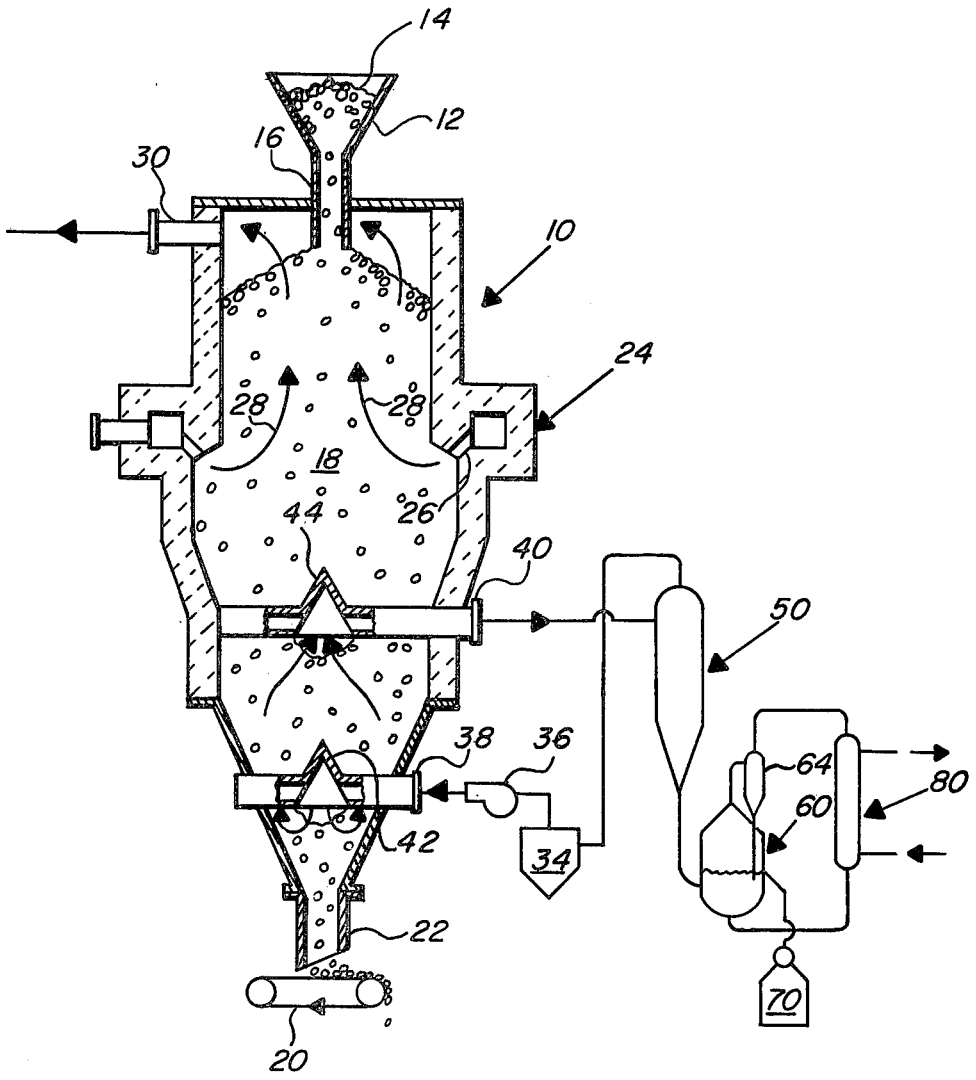
FIG. 1 is a schematic diagram of a direct reduction shaft furnace showing the cooling zone gas cleaning and recirculation system including the invented apparatus for cooling and collecting fines from the cooling zone.

Referring now to FIG. 1, a typical vertical shaft furnace 10 has a top-mounted feed hopper 12 into which iron oxide pellets 14 or other particulate material such as lump ore are charged. The pellets descend by gravity through one or more feed pipes 16 to form a burden 18 within the shaft furnace. Direct reduced product is removed from the shaft furnace by discharge conveyor 20 located beneath furnace discharge pipe 22. Intermediate the ends of the furnace is a bustle and tuyere system indicated generally as 24, having gas ports 26 through which hot reducing gas is introduced to the interior of the furnace to flow upwardly in counterflow relationship to the movement of the burden 18 as indicated by the arrows 28. Spent top gas exits the furnace through gas takeoff pipe 30 at the top of the furnace.

In the lower portion of the shaft furnace a loop recirculating system is provided to cool the pellets prior to their discharge. The system includes a scrubber cooler 34, a recirculating gas blower 36, a gas inlet 38, and a gas outlet 40. Inlet 38 leads to a cooling gas distributing member 42 within the furnace. Cooling gas collecting member 44 is positioned above the distributing member 42 and is connected to outlet 40.

Figure 2:
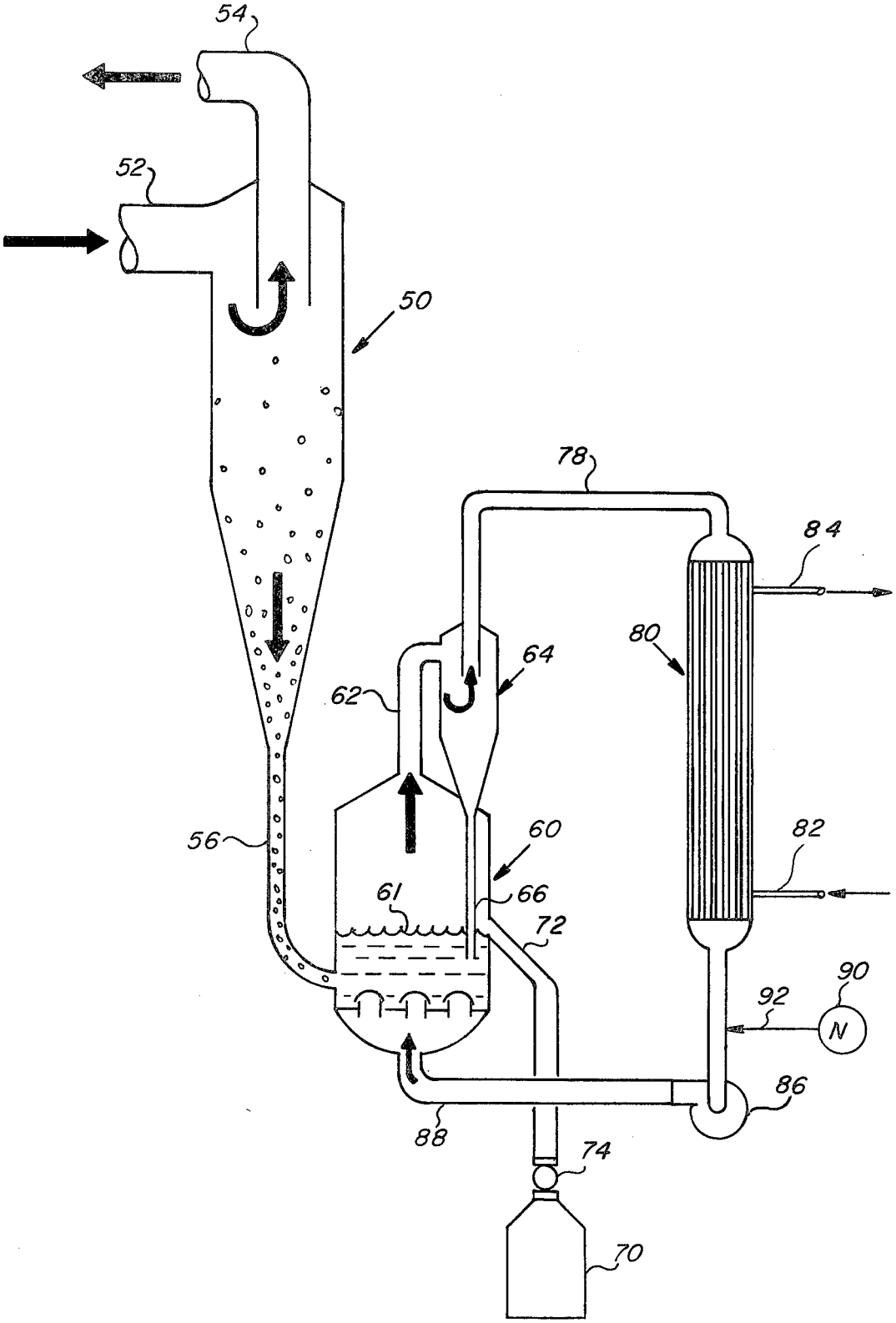
FIG. 2 is a schematic diagram of the fluid bed fines cooler-collector of FIG. 1 on a larger scale.

As better shown in FIG. 2 the cooling gas recirculating system includes apparatus for cooling and collecting finely divided material carried out of the cooling zone by the recycled cooling gas. A cyclone 50 has a hot gas inlet 52 at its upper end for admitting hot particulate-containing (fines-containing) gas, a gas removal pipe 54 at its top and a particulate removal pipe 56 at its lower end. Pipe 56 communicates with a fluidized bed cooling vessel 60 beneath the level 61 of the fluidizing zone in the vessel. A gas takeoff pipe 62 is connected to a second cyclone dust collector 64 which has a fines returned pipe 66 at its lower end for returning particulate materials to the fluidized bed in vessel 60, also beneath the level of the fluidizing zone. A fines collecting vessel 70 is connected to vessel 60 via cooled fines overflow pipe 72. Valve 74 in line 72 allows the changing of the fines collector vessel 70 without loss of pressure in vessel 60. Gas recirculating pipe 78 leads from the upper end of cyclone 64 to an indirect water-cooled heat exchanger 80. Cooling water enters the heat exchanger through pipe 82 and is removed via pipe 84. The cooled gas from the heat exchanger is recirculated through blower 86 and return pipe 88 to the bottom of vessel 60 wherein it acts as the fluidizing and cooling gas.

In operation, hot gases containing entrained particles leave the cooling zone of direct reduction furnace 10 at a temperature on the order of 500° C. and are introduced to cyclone 50 through pipe 52. The fine particulate material drops to the bottom of the cyclone by gravity then passes through pipe 56 into fluidized bed cooling vessel 60. Cool gas, at a temperature above the dew point of the gas in the cooling zone of the direct reduction furnace, is blown into the bottom of the cooling vessel creating an expanded fluid bed and cooling the fines within the bed. The cooled fines continuously overflow from vessel 60 into pipe 72 from whence they pass into container 70. By closing valve 74 the containers can be changed and transported to a location at which the fines are to be utilized. The gases which have been warmed by the hot fines in the fluidized bed cooler 60 pass into cyclone 64 in which the remaining fines are separated from the gases. The fines are returned to the fluidized bed cooler through pipe 66. The clean, substantially dust free gas from the cyclone 64 passes through an indirect water cooled heat exchanger 80 at a sufficiently high temperature that no water vapor condenses from the gas passing through the heat exchanger. This prevents rust bonding of fines. The heat exchanger temperature must be, as before, higher than the dew point of the gas in the cooling zone of the direct reduction furnace. The cooled gases from the heat exchanger 80 are recirculated into the bottom of vessel 60 wherein this cooled gas acts as the fluidizing and cooling medium for the hot iron fines.

Typical operating parameters for the embodiment of FIG. 1 are shown in Table I.

TABLE I

| Reference Numeral | Temperature | Flow Rate |
|---|---|---|
| Pipe 56 | 500° C. | 3300 kg/hr |
| Pipe 78 | 65° C. | 8000 $m^3$/hr |
| Pipe 88 | 55° C. | 8000 $m^3$/hr |
| Collector 70 | 65° C. | — |
| Water Pipe 82 | 50° C. | 120 l/min |
| Water Pipe 84 | 55° C. | 120 l/min |

ALTERNATIVE EMBODIMENT

The broad concept of the present invention has been shown and described with respect of FIG. 1. An alternative embodiment is shown in FIG. 2 whereby a small stream of dry gas from source 90 is injected into the cooling gas recirculating circuit through a gas inlet 92. Since this gas circuit is essentially a closed loop only a small quantity of dry gas will be required. Although nitrogen is the preferred gas, any inert gas will be suitable for this purpose. The injection of such gas will cause the recirculating gas to have essentially the composition of the injected gas. The injection of dry gas will allow the recirculating gas to be at a temperature below the dew point of the cooling gas in the cooling gas circuit of the furnace. It will also allow cooler 80 to utilize colder water and thus cool the gas and the metallized fines to approximately 40° C. This will render the fines less subject to reoxidation than at the higher temperature of 65° C. A further benefit is that no insulation is required on any surfaces of the fines collector system.

Typical operating parameters for the alternative embodiment are shown in Table II.

TABLE II

| Reference Numeral | Temperature | Flow Rate |
|---|---|---|
| Pipe 56 | 500° C. | 3300 kg/hr |
| Pipe 78 | 40–45° C. | 8000 $m^3$/hr |
| Pipe 88 | 25° C. | 8000 $m^3$/hr |
| Collector 70 | 40° C. | — |
| Water Pipe 82 | 20° C. | 120 l/min |
| Water Pipe 84 | 25° C. | 120 l/min |

SUMMARY OF THE ACHIEVEMENT OF THE OBJECTS OF THE INVENTION

From the foregoing, it is readily apparent that we have invented a method and apparatus for the dry collection of metallized fines from the cooling zone of a direct reduction furnace with no loss of metallization and no agglomeration of fines due to rusting.

What is claimed is:

1. A method for cooling and collecting solid fines from the cooling zone of a direct reduction shaft furnace comprising:

(a) removing spent cooling gas and entrained fines from the cooling zone of a shaft furnace;

(b) passing said fines-laden gas into a cyclone dust collector;

(c) separating said fines from said spent cooling gas in said dust collector;

(d) passing said collected fines into a fluidized bed;

(e) maintaining said fines in suspension by blowing a fluidizing gas into said fluidized bed, thereby cooling said fines;

(f) removing cooled fines from said cooler;

(g) removing said fluidizing gas from said cooler; and (h) passing the removed gas through an indirect cooler to cool said gas and returning the cooled gas to said fluidized bed cooler.

2. A method according to claim 1 further comprising removing entrained particles from said recycled fluidizing gas and returning said particles to said fluidized bed.

3. A method according to claim 1 further comprising injecting a dry gas into the cooling gas circuit.

4. A method according to claim 3 wherein said dry gas is inert.

5. A method according to claim 4 wherein said inert gas is nitrogen.

6. A method according to claim 1 wherein the temperature of said fluidizing gas is above the dew point of the gas in the cooling zone of the direct reduction shaft furnace.

7. In apparatus for the dry collection of metallized fines from a direct reduction furnace cooling zone in which the cooling zone cooling system comprises:

a lower cooling gas inlet for introducing a cooling gas to the furnace beneath the reducing zone, a cooling gas outlet above said cooling gas inlet for removing cooling gas from said furnace, the portion of said furnace between said cooling gas inlet and said cooling gas outlet forming a cooling zone;

an external cyclone dust collector having a lower particle discharge outlet and an upper gas discharge outlet;

and a passageway connecting said cooling gas outlet and said cyclone dust collector;

the improvement comprising:

a fluid bed fines cooler having a lower fluidizing gas inlet, an upper gas outlet and an intermediate fines outlet;

said particle discharge outlet of said cyclone dust collector communicating with said fluid bed fines cooler;

an indirect gas cooler, having a gas inlet and a gas outlet, said upper gas outlet of said fluid bed fines cooler communicating with said gas inlet of said indirect cooler communicating with said lower fluidizing gas inlet to said fluid bed fines cooler.

8. Apparatus according to claim 7 further comprising means for injecting an inert gas into said fluidizing gas inlet.

9. Apparatus according to claim 7 further comprising a second cyclone dust collector communicating with the upper gas outlet of said fluid bed fines cooler, and having fines return means communicating with said fluid bed fines cooler for returning particulate materials from said second cyclone to the fluid bed fines cooler.

10. Apparatus according to claim 7 further comprising a fines collector vessel, a passageway between said fines outlet and said vessel, said passageway having a valve therein to allow the disconnection and changing of said fines collector vessel without loss of pressure in said fluid bed fines cooler.

* * * * *